US007129847B2

(12) United States Patent
Right et al.

(10) Patent No.: US 7,129,847 B2
(45) Date of Patent: Oct. 31, 2006

(54) DETECTOR WITH DUST FILTER AND AIRFLOW MONITOR

(75) Inventors: Robert Right, Holmes Beach, FL (US); Hilario Costa, Myakka City, FL (US); Jan Braam, Bradenton, FL (US)

(73) Assignee: Edwards Systems Technology, Inc., Cheshire, CT (US)

( * ) Notice: Subject to any disclaimer, the term of this patent is extended or adjusted under 35 U.S.C. 154(b) by 67 days.

(21) Appl. No.: 10/634,883

(22) Filed: Aug. 6, 2003

(65) Prior Publication Data

US 2005/0030172 A1 Feb. 10, 2005

(51) Int. Cl.
*G08B 17/10* (2006.01)

(52) U.S. Cl. ..... 340/628; 340/606

(58) Field of Classification Search ..... 340/28–630, 340/632, 511, 584, 588
See application file for complete search history.

(56) References Cited

U.S. PATENT DOCUMENTS 5,001,463 A * 3/1991 Hamburger ..... 340/627
5,212,983 A * 5/1993 Ott et al. ..... 73/204.15
5,217,513 A * 6/1993 Armbruster ..... 96/414
5,451,929 A * 9/1995 Adelman et al. ..... 340/521
6,107,925 A * 8/2000 Wong ..... 340/628
6,166,648 A * 12/2000 Wiemeyer et al. ..... 340/630
6,285,291 B1 * 9/2001 Knox et al. ..... 340/634
6,543,282 B1 * 4/2003 Thompson ..... 73/204.15
6,776,817 B1 * 8/2004 Lentz et al. ..... 73/204.26

* cited by examiner

*Primary Examiner*—Daniel Wu
*Assistant Examiner*—Eric Blount
(74) *Attorney, Agent, or Firm*—Baker & Hostetler LLP

(57) ABSTRACT

A device for monitoring changes in airflow rates through detector dust filters in addition to assessing air for alarm indicators, including smoke, heat, gas, and relative humidity, is provided. A method monitors airflow through the detection device and provides a maintenance indication when the airflow has been reduced due to contamination of the dust filters.

22 Claims, 3 Drawing Sheets

10
30
70
55
50
72
shielded leg
74
unshielded leg
12
40
15
25
30
60
AIR FLOW
20

DETECTOR WITH DUST FILTER AND AIRFLOW MONITOR

FIELD OF THE INVENTION

The present invention relates to a device and method for detecting changes in ambient air conditions. More particularly, the present invention relates to a device that monitors changes in airflow rates in addition to assessing air for alarm indicators, including, for example, smoke, heat, gas, and relative humidity. The invention also relates to a method for monitoring airflow through the detection device and providing indication when the airflow has been reduced.

BACKGROUND OF THE INVENTION

Ambient condition detectors have been found to be useful in providing an indication of the presence or absence of the respective condition being detected. Smoke detectors, for example, have been found useful in providing early warning of the presence of airborne particulate matter such as smoke.

Air condition detectors generally have vents that are located within housings, whereby ambient air circulates into and out of the housing in response to movement of the adjacent atmosphere. Heating/Ventilation/Air-conditioning (HVAC)-type duct detectors, alternatively, often sample airflow behind additional internal dust filters, which help to minimize dirt or dust related false alarms. When clean, these filters serve to reduce undesirable dust particles from activating the alarm, while still allowing a steady rate of air to flow through the detection mechanism. However, dust filters periodically and chronically become clogged over time and in such an event, airflow becomes reduced or eliminated.

In other situations, reduced airflow may be due to normal operating conditions and not the result of dust filter contamination. In large commercial buildings, for example, air circulation is often achieved by centralized heating and cooling systems, and the building control systems may be programmed to alter airflow in response to preset schedules. Hence, there may be times of minimal or no circulation, such as during evenings or weekends, which may be falsely indicative of contamination from the filter.

The ability of ambient air condition detectors to operate effectively depends to some degree on the capacity to sample consistent and representative samples of the environmental air. However, in certain scenarios as mentioned above, the ability to sample air becomes compromised as the filters therein become progressively contaminated.

Therefore, there continues to be a need for devices and methods to monitor airflow and allow supervision of internal dust filters by providing a maintenance indication means when the airflow has been reduced due to contamination. It is also desirable to provide an airflow detection arrangement that is able to sample the airflow through the air filter relative to ambient airflow conditions so as to allow for environmental compensation in assessing airflow restriction due to clogged filters.

SUMMARY OF THE INVENTION

The foregoing needs are met, at least in part, by the present invention where, in one embodiment, a device is provided for use in air condition detection having a filter incorporated therein to remove particulate dust matter, an airflow detection means for monitoring airflow through the filter, and an indication means for signaling airflow restriction due to filter contamination. The above and other aspects, features and advantages are achieved in some embodiments through the novel use of a thermistor bridge to simultaneously sample airflow through the detector and the surrounding environment.

In accordance with another embodiment of the invention, a device for detecting an ambient condition is provided, comprising a first sensor to determine the presence of a condition and provide an alarm signal, an airflow monitor that monitors an airflow level and provides an airflow signal, and a processor that provides a status message indicative of the state of the alarm signal and the airflow signal. Additional sensors may be coupled to the device and may include photoelectric smoke sensors, ionization-type smoke sensors, $CO_2$, gas, heat, and relative humidity sensors. Some sensors may also include filters to remove unwanted particles and can be adapted for HVAC use.

In accordance with another embodiment of the invention, a detection system for detecting ambient conditions is provided, comprising a first sensing means for determining the presence of an ambient condition and for providing an alarm signal, an airflow monitoring means for monitoring the airflow through the sensing means, and a processing means coupled to the sensing means for providing a status message.

In accordance with yet another embodiment of the invention, a method of using a device for detecting ambient conditions is provided, comprising sensing the presence of an ambient condition and providing an alarm signal, monitoring an airflow rate through the device, comparing the airflow rate through the device with a chosen threshold airflow rate to provide an airflow signal, and providing a status message indicative of the state of the alarm signal and the airflow signal.

There has thus been outlined, rather broadly, several features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DESCRIPTION OF THE INVENTION

Figure 1:
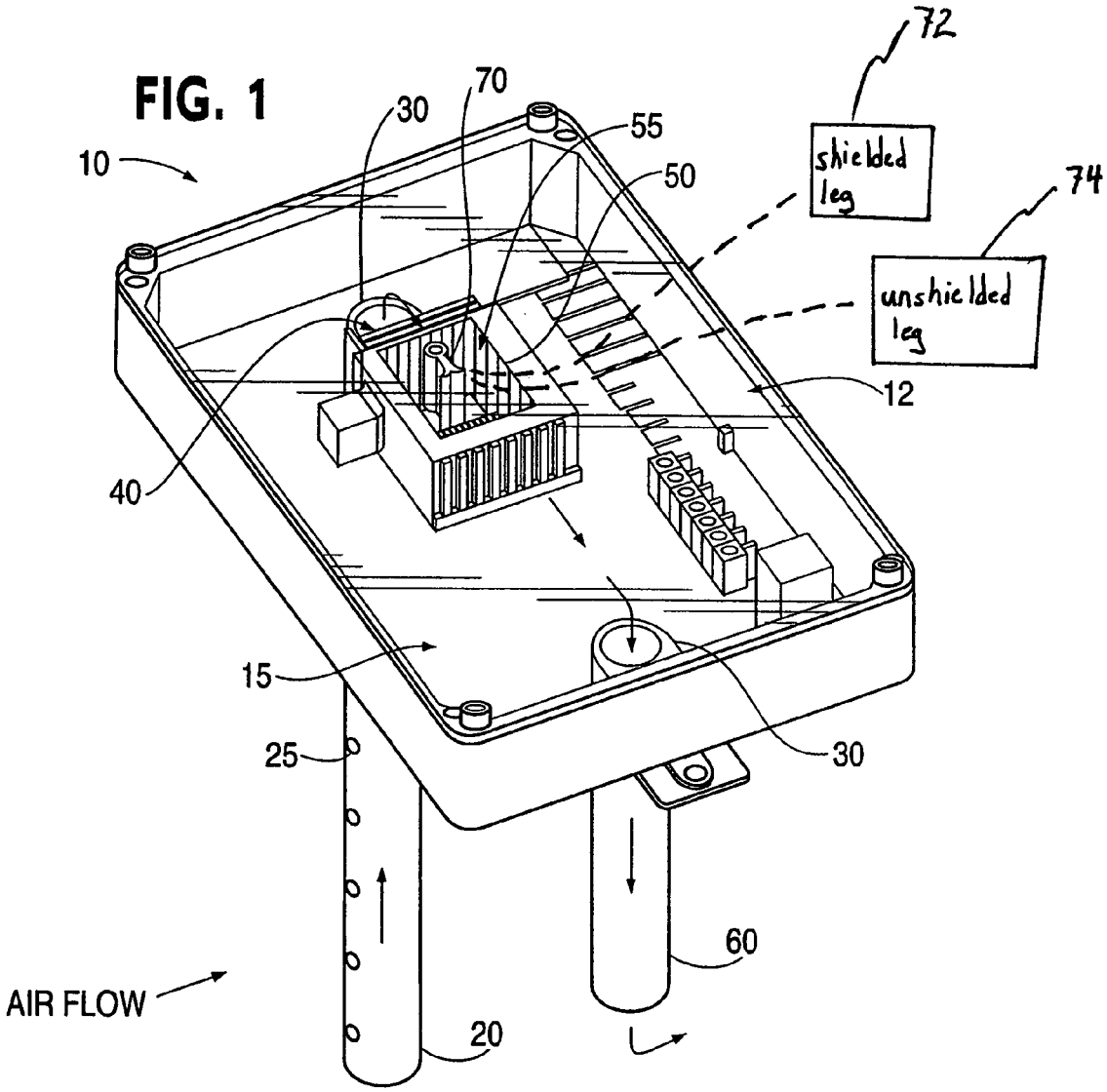
FIG. 1 is a cutaway perspective view of the interior of a detector in accordance with an embodiment of the present invention.

Some preferred embodiments of the invention provide, for example, devices and methods to monitor airflow and allow supervision of internal dust filters by providing a maintenance indication means when the airflow has been reduced due to contamination, and also provide an airflow detection arrangement that is able to sample the airflow through the air filter relative to ambient airflow conditions so as to allow for environmental compensation in assessing airflow restriction due to clogged filters. Preferred embodiments will now be described with reference to the drawing figures in which like reference numerals refer to like element throughout.

FIG. 1 illustrates a detector 10 in accordance with one embodiment of the present invention. The detector 10 is shown with a cover 12, optionally transparent, sample tube 20, a filter 30, a screen 40, a sensor 50, and an exhaust tube 60. The detector 10 is preferably adapted for and positioned within a Heating/Ventilation/Air Condition (HVAC) duct, both in the air supply and/or the air return of a building. However, detectors of the present invention may be installed in any location.

In order to sample the ambient airflow through the duct, the detector 10 is equipped with a sample tube 20. The sample tube 20 can be further perforated with sampling holes 25 as shown. Having a plurality of sampling holes 25 permits airflow into the detector 10 in the event one or more of the holes 25 becomes clogged with contamination. The diameter of the sample tube 20 and holes 25 should preferably be small enough to prevent entry of particularly large debris, but yet large enough to permit sufficient airflow through the tube.

Once the ambient air has traversed the sample tube 20, it enters the detector chamber 15 of the detector 10. Once in the detector chamber 15, the ambient air encounters a filter 30. The filter 30 is preferably an in-line filter with porosity to prevent passage of visible particulate matter, that may have entered the chamber 15. Such contamination may include, for example, dirt, dust, fiber, and/or powder. The filter 30 may comprise materials known in the art including polyfoam plugs.

Next, before entering the sensor 50, the ambient air travels through a screen 40. The screen 40 is preferably an in-line screen with porosity to prevent microscopic matter from passing through the screen 40. As such, the screen 40 should be designed to eliminate spores, mites, and the like. Both the filter 30 and the screen 40 should not be chosen to be so fine as to prevent the passage of particulate matter that may be present in smoke, which should pass into sensor 50. Any of suitable fine mesh filters and screens known and present in the art may suffice.

The ambient air that passes through the filter 30 and screen 40 is then analyzed by a sensor 50. The sensor 50 can include, but are not limited to, gas, heat, $CO_2$, smoke (including photoelectric-type or ionization-type), and relative humidity sensors. The sensor 50 is preferably encased in a sensor chamber 55. The sensor chamber 55 is equipped with a device configured for detecting and assessing the presence and rate of airflow through sensor chamber 55. In the embodiment shown in FIG. 1, an airflow thermistor 70 is installed to detect such airflow changes.

In one embodiment, a negative temperature coefficient thermistor may be used. Thermistor "bridges" for use in the present invention can have one leg shielded from the airflow, providing a baseline temperature when no air is flowing. The other leg of the thermistor bridge can be placed in the ambient airflowing through sensor chamber 55. The presence of airflowing over and around the unshielded leg will generate a lower temperature reading relative to the shielded leg. The negative temperature differential, then, can be interpreted to be indicative of airflow where lack of a differential is indicative of no airflow. As will be understood to one of ordinary skill in the art from the teachings herein, the differential may also be calibrated to indicate relative, gradual changes in airflow levels.

The ambient air passes through the sensor chamber 55 and out through an exhaust tube 60. The exhaust tube 60 leads the air back into the air duct or source from which the air was first sampled. Optionally, a screen 40 may be installed in the exit path of sensor 50 (as shown). Likewise, a filter 30 may also be installed in the exhaust tube 60.

Figure 2:
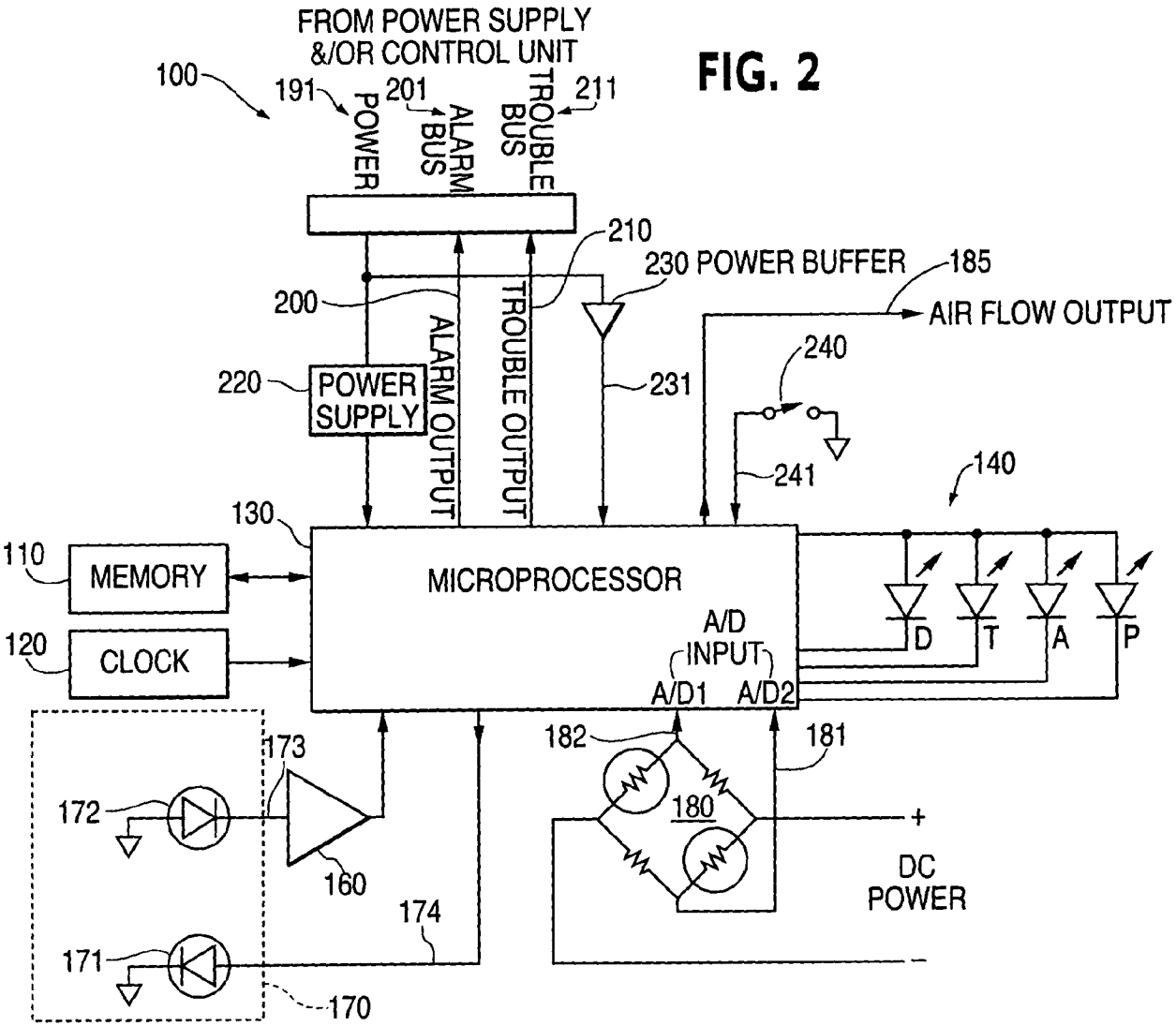
FIG. 2 is a block diagram of a detector access to one embodiment of the present invention.

FIG. 2 shows a detail of a detector 100 in one embodiment of the present invention. The detector 100 may be a stand-alone unit or coupled to a separate control unit. Both such embodiments are within the scope of the present invention. Also in the embodiment shown, the sensor is a smoke sensor; however, as mentioned, the sensors of this invention are not limited to smoke sensors.

The detector 100 includes a memory 110, a clock 120, a microprocessor 130, status lights 140, a power supply 220, an amplifier 160, a smoke sensing chamber 170, and a thermistor 180. The smoke sensing chamber 170 comprises an infrared (IR) light-emitting diode (LED) transmitter 171 and a photo diode receiver 172. The transmitter 171 and receiver 172 are generally positioned at 90-degree angles to one another. In the absence of smoke then, the light from transmitter 171 bypasses receiver 172. When smoke enters the chamber 170, however, the smoke particles scatter light from transmitter 171 and some amount of light is detected by receiver 172. The signal 173 from the receiver diode 172 is further amplified by the amplifier 160 en route to the microprocessor 130.

The microprocessor 130 may be calibrated to monitor changes in the signal 173 compared to a transmitter signal 174 that is relayed to IR LED transmitter 171. The microprocessor clock 120 may be integral or peripheral to microprocessor chip 130. As with the clock 120, memory 110 may also be integral or peripheral to the microprocessor chip 130. The status lights 140 may be LEDs to signal to the operator conditions such as, for example, trouble, alarm, and/or power status of the detector 100. In some embodiments, the status lights may be replaced by or combined with an audio annunciation. Likewise, if the detector 100 is equipped with a filter to remove particulate matter from the airflow though the smoke sensing chamber 170, then an LED for the dirt level of the filter may also be included on the status light display 140.

The status light display 140 may be comprised of a series of LEDs. When lit, the LEDs may signal proper function or the indication of an alarm condition. Alternatively, the detector may be designed such that proper function or indication of alarm condition is indicated by unlit LEDs. A combination of light signaling can also be implemented. In some embodiments, a single light may be used to display multiple conditions. The same concept may be applied to audio annunciation.

In embodiments where the detector is coupled to a central control unit, a power source, an alarm output 200, and a trouble output 210, are each coupled to a power bus 191, an alarm bus 201, and a trouble bus 211, respectively, and operably coupled to the microprocessor 130. The microprocessor 130 is supplied power through a power supply 220 and may be equipped with a power monitor input 231.

Intermittent disruptions in power to the microprocessor 130 below or above a chosen threshold may be detected by power buffer 230. In some embodiments, power to the microprocessor 130 maybe deliberately dropped by an operator to signal sensor functions to be performed. In such an embodiment, a function is assigned for a given duration of power cessation. The power source can be 120V AC, 220V AC, and 24V AC/DC.

In some embodiments, the sensors and detectors of the present invention may be equipped with a reed switch 240. In this embodiment, the reed switch 240 is turned on when a magnet is brought into proximity by an operator. Upon this turning-on of the reed switch 240, a test signal 241 is relayed to the microprocessor 130. The length of time the magnet is placed in proximity to the reed switch 240 will indicate the time of engagement which may also indicate the type of test desired by the operator.

The microprocessors of this invention may be equipped to determine not only the presence or absence of the condition being sensed, but also the status level of the condition being sensed relative to a baseline or threshold value. In other words, a microprocessor of a temperature sensor in some embodiments may be calibrated to not only read the temperature level, but also be able to compare the temperature to a preset threshold. Such a threshold may be adjustable or may be set to ambient temperature. As the temperature of certain buildings may be preset to rise or fall at certain set cycles, so too are microprocessors of the present invention preferably embodied to take the ambient rise and fall in temperature into account when signaling an alarm condition. The same process described above for temperature sensors may also be similarly applied to $CO_2$, smoke, and/or relative humidity sensors, and airflow monitors.

Where airflow sensors are incorporated, it is desirable to provide a microprocessor that is able to distinguish restrictions in airflow from air filter contamination versus restrictions in airflow from preset reduction in air circulation. Particularly with ambient air condition detectors where filters are placed internally to remove unwanted particulate matter from initiating false alarm signals, airflow can often become compromised when the filters get contaminated. On the other hand, where airflow is deliberately reduced at certain periods of the day, airflow through the sensor can also be reduced.

Any device for detecting and comparing airflow may be incorporated in the present invention, including the use of a thermistor 180. The thermistor 180 can have one leg 181 in the airflow and one leg 182 shielded from the airflow. A negative temperature coefficient thermistor can detect changes in the temperature readings from the legs 181 and 182 and send the reading to the microprocessor 130. The microprocessor 130 can then interpret the differential readings from legs 181 and 182 to assess airflow rates based on a calibrated baseline rate/reading. The airflow output 185 may be transferred by both analog or digital means.

Figure 3:
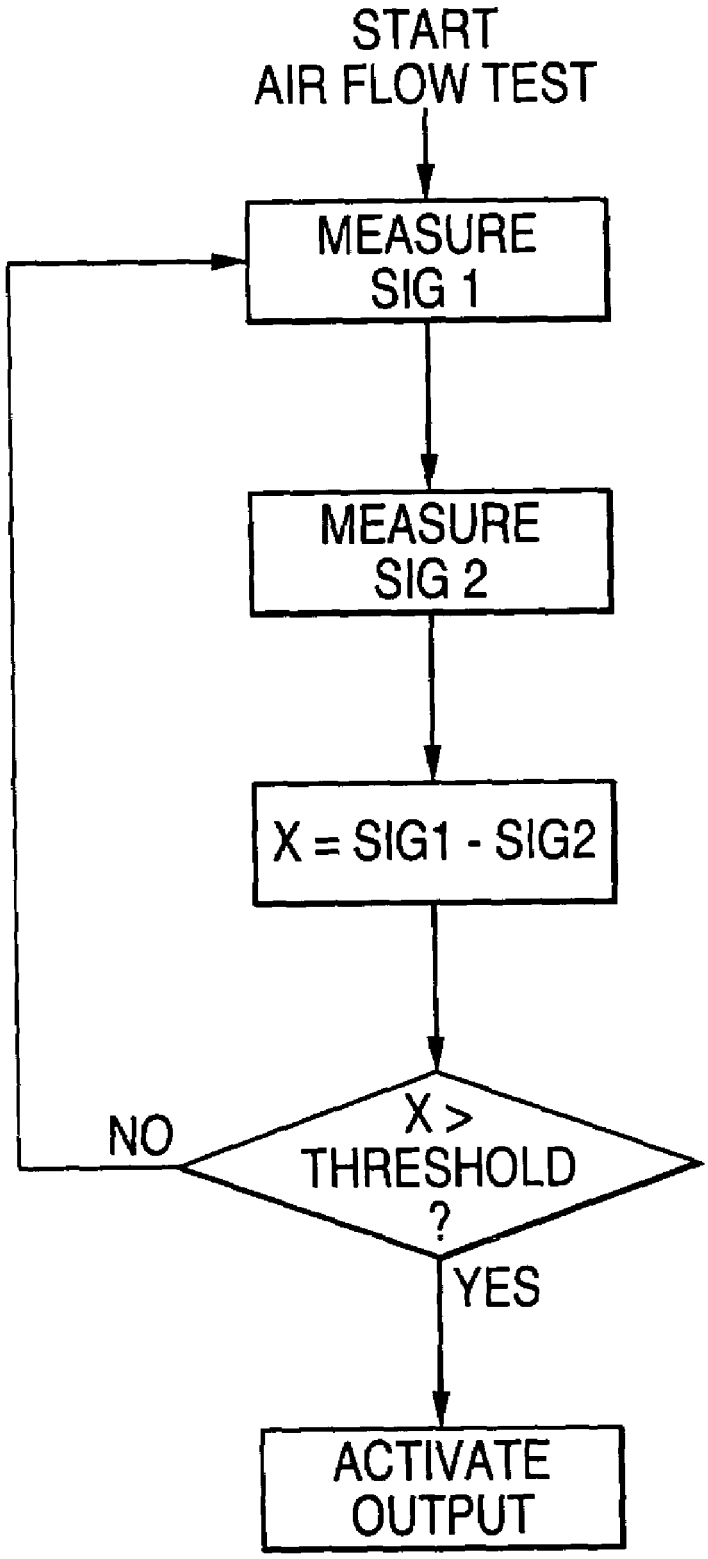
FIG. 3 is a flow chart of the logic operation of the test for filter contamination in one embodiment.

FIG. 3 shows a flow chart of the logic operation for the airflow rate ("airflow test") in one embodiment of the present invention. An airflow test can be initiated by an operator by the reed switch, for example, or automatically at preset intervals. The microprocessor 130 then measures the reading from one leg of the thermistor 130, S1 (e.g., leg 181) and then similarly measures the reading from the other leg of the thermistor 130, S2 (e.g., leg 182). Then, the microprocessor 130 calculates the differential between S1 and S2. If the differential is above a (or below) chosen threshold, then an output is activated to indicate the state of airflow. Alternatively, if no threshold is met, no indication is signaled. In other embodiments, a matrix of discrete threshold levels may be programmed into the microprocessor 130 such that multiple relative levels of airflow may be assessed and signaled to the operator.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A device for detecting an ambient condition, comprising:

a first sensor to determine the presence of a condition, and provide an alarm signal;

a filter disposed proximate to the first sensor such that an airflow passes through the filter before reaching the first sensor, wherein the filter is configured to prevent a particulate located in the airflow from reaching the first sensor;

an airflow monitor that is configured to detect changes in the airflow resulting from the particulate collecting in the filter, the airflow monitor comprises a first element exposed to the airflow and a second element shielded from the airflow and exposed to an ambient environment, wherein the first element is configured to determine an airflow condition, the second element is configured to determine an ambient condition, and the airflow monitor is configured to provide an airflow signal based upon the determination of the first and second elements; and a processor that provides a status message indicative of the state of the alarm signal and the airflow signal.

2. The device of claim 1, wherein said airflow monitor comprises a thermistor.

3. The device of claim 1, further comprising a second sensor to determine the presence of a second condition and provide a second alarm signal.

4. The device of claim 1, wherein said first sensor is a photoelectric smoke sensor.

5. The device of claim 1, wherein said first sensor is an ionization-type smoke sensor.

6. The device of claim 1, wherein said first sensor is a heat sensor.

7. The device of claim 1, wherein said first sensor is a relative humidity sensor.

8. The device of claim 1, wherein said first sensor is a $CO_2$ gas sensor.

9. The device of claim 1, wherein the filter comprises a polyfoam portion configured to prevent passage of visible particulate matter and a screen portion configured to prevent passage of microscopic matter.

10. The device of claim 1, wherein the airflow monitor is a negative temperature coefficient thermistor and the airflow signal is a temperature difference between the first and second element.

11. The device of claim 1, wherein said processor compares the monitored airflow level to a low airflow threshold and provides an airflow alarm signal indicative of a low airflow level when the monitored airflow level is lower than the low airflow threshold.

12. The device of claim 11, wherein the low airflow threshold is adjustable.

13. The device of claim 11, wherein said low airflow threshold is substantially equal to ambient airflow.

14. The device of claim 11, further comprising a second sensor to determine the presence of a second condition and provide a second alarm signal.

15. The device of claim 14, wherein at least one of said first and second sensors is adapted for location in a HVAC duct.

16. A detection system for detecting ambient conditions, comprising:

first sensing means for determining the presence of a first ambient condition and for providing a first alarm signal;

filtering means disposed proximate to the first sensing means such that an airflow passes through the filtering means before reaching the first sensing means, wherein the filtering means is configured to prevent a particulate located in the airflow from reaching the first sensing means;

airflow monitoring means that is configured to detect changes in the airflow resulting from the particulate collecting in the filtering means, the airflow monitoring means comprises a first element exposed to an airflow and a second element shielded from the airflow and exposed to an ambient environment, wherein the first element is configured to determine an airflow condition, the second element is configured to determine an ambient condition, and airflow monitoring means provides an airflow signal based upon the determination of the first and second elements; and processing means coupled to said sensing means and said airflow monitoring means for providing a status message.

17. The detection system of claim 16, wherein said sensing means is a photoelectric smoke sensor.

18. The detection system of claim 16, wherein said sensing means is an ionization-type smoke sensor.

19. The detection system of claim 16, wherein said sensing means is adapted for location in a HVAC duct.

20. The detection system of claim 16, further comprising a second sensing means for detecting presence of a second condition.

21. A method of using a device for detecting ambient conditions, comprising:

sensing the presence of an ambient condition and providing an alarm signal;

monitoring an airflow rate through the device;

comparing the airflow rate through the device with a chosen threshold airflow to provide an airflow signal; and providing a status message indicative of the state of the alarm signal and the airflow signal, wherein an airflow monitor is utilized to monitor the airflow rate through the device, the airflow monitor is configured to detect changes in the airflow rate and comprises a first element exposed to an airflow and a second element shielded from the airflow and exposed to an ambient environment, wherein the first element is configured to determine an airflow condition, the second element is configured to determine an ambient condition.

22. The method of claim 21, wherein the ambient condition is a smoke condition.

* * * * *